US007506967B2

(12) United States Patent
Kim et al.

(10) Patent No.: US 7,506,967 B2
(45) Date of Patent: Mar. 24, 2009

(54) INK JET HEAD HAVING AN ELECTROSTATIC ACTUATOR, INK CARTRIDGE, AND INKJET PRINTER

(75) Inventors: Young-Jae Kim, Suwon-si (KR); Jae-Seong Lim, Suwon-si (KR); Sung-Il Oh, Seoul (KR)

(73) Assignee: Samsung Electro-Mechanics Co., Ltd, Suwon-si (KR)

( * ) Notice: Subject to any disclaimer, the term of this patent is extended or adjusted under 35 U.S.C. 154(b) by 385 days.

(21) Appl. No.: 11/340,656

(22) Filed: Jan. 27, 2006

(65) Prior Publication Data

US 2006/0203039 A1 Sep. 14, 2006

(30) Foreign Application Priority Data

Mar. 11, 2005 (KR) ..... 10-2005-0020531

(51) Int. Cl.
*B41J 2/06* (2006.01)

(52) U.S. Cl. ..... 347/55; 347/68

(58) Field of Classification Search ..... 347/55, 347/68–72

See application file for complete search history.

(56) References Cited

FOREIGN PATENT DOCUMENTS

| | | |
|---|---|---|
| JP | 61-42284 | 2/1986 |
| JP | 1997-183226 | 7/1997 |
| JP | 2000-255494 | 9/2000 |
| JP | 2001-47624 | 2/2001 |
| JP | 2003/276194 | 9/2003 |
| JP | 2004-209725 | 7/2004 |
| KR | 1999-54470 | * 7/1999 |
| KR | 10-0242157 | 11/1999 |
| KR | 2003-276194 | 9/2003 |

OTHER PUBLICATIONS

Chinese Office Action dated Oct. 26, 2007 issued in CN 2006100078533.
Korean Office Action dated Jul. 24, 2006 issued in KR 2005-20531.
Japanese Office Action dated Sep. 3, 2008 issued in JP 2006-27786.

* cited by examiner

*Primary Examiner*—Juanita D Stephens
(74) *Attorney, Agent, or Firm*—Stanzione & Kim, LLP

(57) ABSTRACT

An inkjet head having an electrostatic actuator and a manufacturing method of the same are disclosed. The inkjet head having an electrostatic actuator, comprising a stator, on which is formed a plurality of comb pattern shaped first protrusion parts and second protrusion parts in both directions, and a rotor consisting of a first component and a second component, the ends of which join with the diaphragm, wherein a third protrusion part is formed on the first component, facing the first protrusion parts and meshing with the first protrusion parts without contact; and a fourth protrusion part is formed on the second component, facing the second protrusion parts and meshing with the second protrusion parts without contact, may decrease the size of the head composition and may increase the electrostatic force so that a large displacement may be obtained with little voltage to increase the ink discharge pressure.

18 Claims, 12 Drawing Sheets

INK JET HEAD HAVING AN ELECTROSTATIC ACTUATOR, INK CARTRIDGE, AND INKJET PRINTER

CROSS-REFERENCE TO RELATED APPLICATIONS

This application claims the benefit of Korean Patent Application No. 2005-20531 filed with the Korea Industrial Property Office on Mar. 11, 2005, the disclosure of which is incorporated herein by reference.

BACKGROUND OF THE INVENTION

1. Field of the Invention

The invention relates to a printer head, in particular to an inkjet head having an electrostatic actuator and a manufacturing method of the same.

2. Description of the Related Art

Operation types for inkjet heads include a thermal type and a piezoelectric type. For the thermal type, a heater is installed which can supply heat into the chamber by which a substantially large amount of thermal energy may be supplied in a short period of time, and bubbles are formed in the ink in the chamber so that the ink is sprayed out through nozzles. However, there are problems in durability, caused by repeated impact due to the pressure from the bubbles created by the heat; it is difficult to control the size of ink droplets; and there is a limit to increasing the printing speed.

Meanwhile, the piezoelectric type utilizes the piezoelectric property, which is force being generated when voltage is supplied, by attaching piezoelectric material on a diaphragm to apply pressure to the chamber of the head, so that the pressure provided to the chamber pushes the ink out. Since it involves applying pressure in the chamber via force generated by the voltage supplied, it yields excellent performance in terms of speed and is thus widely used.

FIG. 1 is a cross sectional view of a conventional piezoelectric type inkjet head. As in FIG. 1, a conventional piezoelectric type inkjet head comprises a substrate 7, a diaphragm 8, a piezoelectric element 9, partitions 10, and a nozzle plate 1. In a piezoelectric type inkjet head with such a configuration, the piezoelectric element 9 mechanically expands and contracts when control signals are sent to the piezoelectric element 9 from a control signal generator 4, with the expanding and contracting of the piezoelectric element 9 causing the ink 5 in the chamber 2 to be pushed out of the nozzle 3 as discharged ink droplets 6.

However, piezoelectric type inkjet heads are expensive, because they use costly piezoelectric elements, and the yield is low due to a complicated manufacturing process, since the piezoelectric elements must be carefully coordinated with the electrodes, insulation layer, and protection layer, etc.

To overcome the above problems, inkjet heads that use electrostatic force are currently in use. These inkjet printer heads are fast becoming the inkjet head type of choice because of such advantages as ease in manufacture, low power consumption, and simple mechanism.

FIG. 2 is a cross sectional view of a conventional electrostatic type inkjet head, as shown in FIG. 1 of U.S. Pat. No. 5,894,316, illustrating an inkjet head having a diaphragm. As illustrated in FIG. 2, a conventional electrostatic type inkjet head comprises a glass plate 11, a lower substrate 13 mounted with a constant gap from the glass plate 11, an upper substrate 16 mounted on the upper face on which is formed a nozzle 15 for the passage of ink discharge, a center substrate 14 placed between the upper substrate 16 and the lower substrate 13 and mounted on both sides of the lower substrate 13, and an ink chamber 17 enclosed by the above and forming a chamber wherein ink is stored. As shown in FIG. 2, another electrode is mounted on the lower surface 13 facing the electrode 12 mounted on the glass plate 11 with a gap G in between.

In an electrostatic type inkjet head with such a configuration, the two electrodes are oppositely charged when power is supplied, so that there is an attraction force pulling each other. Therefore, the electrode mounted on the ink-storing chamber is pulled toward the other electrode 12. When the power is shut off, the pulled electrode returns to its original state, which applies pressure to the ink inside the chamber. This pressure causes the ink to be discharged through the nozzle to the exterior.

In such an electrostatic type inkjet printer head, the ink chamber on which pressure is applied must be formed to be greater than a certain size, and to increase the electrostatic force and lower the rigidity of the thin film which acts as the electrode, the electrodes must have a large area facing each other. This causes an increase in the occupied area per nozzle and the nozzle intervals are made wider, so that there is a limit to increasing the resolution of the printer and the manufacturing costs are increased. Also, additional metal must be deposited to form the electrodes, which causes the manufacturing process to be more complicated.

Examples of existing techniques to improve ink discharge pressure in electrostatic type inkjet heads include, first, Korean patent no. 10-0242157 ('electrostatic actuator type inkjet printer head'). However, in this invention, the finger is protruded in one direction only, the diaphragm is pressurized by one electrostatic actuator, and the electrostatic actuator is secured only to the diaphragm, so that there is a limit to increasing electrostatic force.

A second example may be Japanese patent no. 2003-276194 ('electrostatic actuator, droplet discharge head, and inkjet printer device'). However, in this invention, the finger is protruded in one direction only, the actuator body is not partitioned by the frame into individual components, and electrostatic force is increased by superposing several layers for the flat plates of the operation electrode and the fixed electrode, so that a large displacement is not always obtained depending on the distance between electrodes.

SUMMARY OF THE INVENTION

An object of the invention is to provide an inkjet head having an electrostatic actuator and a manufacturing method of the same, which may decrease the size of the electrostatic type inkjet head composition and may increase the electrostatic force so that a large displacement may be obtained with little voltage to increase the ink discharge pressure.

Additional aspects and advantages of the present general inventive concept will be set forth in part in the description which follows and, in part, will be obvious from the description, or may be learned by practice of the general inventive concept.

One aspect of the invention is to provide an inkjet head having an electrostatic actuator, comprising: one or more stators, on which a plurality of first protrusion parts are formed in a comb pattern shape, one or more rotors, on which a plurality of second protrusion parts are formed by facing the first protrusion parts and meshing with the first protrusion parts without contact, and a diaphragm joined to an end of the rotors.

Preferably, the rotor should be the shape of an enclosure which houses the stator in its interior.

Another aspect of the invention is to provide an inkjet head having an electrostatic actuator, comprising: a stator, on which is formed a plurality of comb pattern shaped first protrusion parts and second protrusion parts in both directions, and a rotor consisting of a first component and a second component, one ends of which join with the diaphragm, wherein a third protrusion part is formed on the first component, facing the first protrusion parts and meshing with the first protrusion parts without contact, and a fourth protrusion part is formed on the second component, facing the second protrusion parts and meshing with the second protrusion parts without contact.

Both ends of the first component and the second component may be joined so that the rotor forms an enclosure which houses the stator in its interior.

The enclosure may have a hexagonal or elliptical shape, and preferably, the shortest distance between the first protrusion part and the first component or the shortest distance between the second protrusion part and the second component should be greater than the distance between the first protrusion part and the third protrusion part or the distance between the second protrusion part and the fourth protrusion part.

The shape of a cross section in the direction of protrusion in one or more of the first protrusion part to the fourth protrusion part may be rectangular. Two or more of the first protrusion part to the fourth protrusion part may have an identical form.

The stator or the rotor may comprise single crystal silicon, and should preferably be produced by MEMS (Micro Electro Mechanical System) processes.

Also, the inkjet head having an electrostatic actuator should preferably further comprise a frame, which houses an electrostatic actuator consisting of the stator and the rotor housing the stator, an ink chamber housed in the frame and comprising a diaphragm on one or more faces, an ink nozzle formed on a side of the ink chamber, and an ink injection opening joined to the ink chamber, wherein an end of the electrostatic actuator joins with the diaphragm.

Preferably, the cross section of the ink chamber should be a polygon, a diaphragm should optionally be included on each side of the polygon, and the electrostatic actuator should be joined to each diaphragm. A plurality of electrostatic actuators may be joined to the diaphragm.

Still another aspect of the invention is to provide an inkjet printer having an electrostatic actuator comprising an ink cartridge comprising an inkjet head having the electrostatic actuator, and an operation circuit which supplies power to the stator or the rotor.

Yet another aspect of the invention is to provide a method of manufacturing an inkjet head having an electrostatic actuator comprising a stator and a rotor by joining a processed glass substrate onto a processed SOI substrate, wherein the method of processing the SOI substrate comprises: (a-1) forming a PR coating layer on a SOI (Silicon on Insulator) substrate comprising an oxide layer, (a-2) forming a pattern of the electrostatic actuator on the PR coating layer (PR patterning), (a-3) etching a silicon layer of the SOI substrate up to the oxide layer according to the pattern formed in step (a-2), and (a-4) wet etching the parts of the oxide layer on which the rotor is formed, using a dilute HF solution, and wherein the method of processing the glass substrate comprises: (b-1) attaching a DFR (Dry Film Resistor) to the upper face of the glass substrate by thermo compression, (b-2) dry etching a cavity onto parts of the bottom face of the glass substrate corresponding to the rotor, and (b-3) perforating parts of the glass substrate corresponding to the stator.

The joint between the processed SOI substrate and the processed glass substrate may be formed by anodic bonding. Step (a-3) may be performed by dry etching. The etching of step (b-2) or the perforating of step (b-3) may be performed by sandblasting.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

Figure 1:
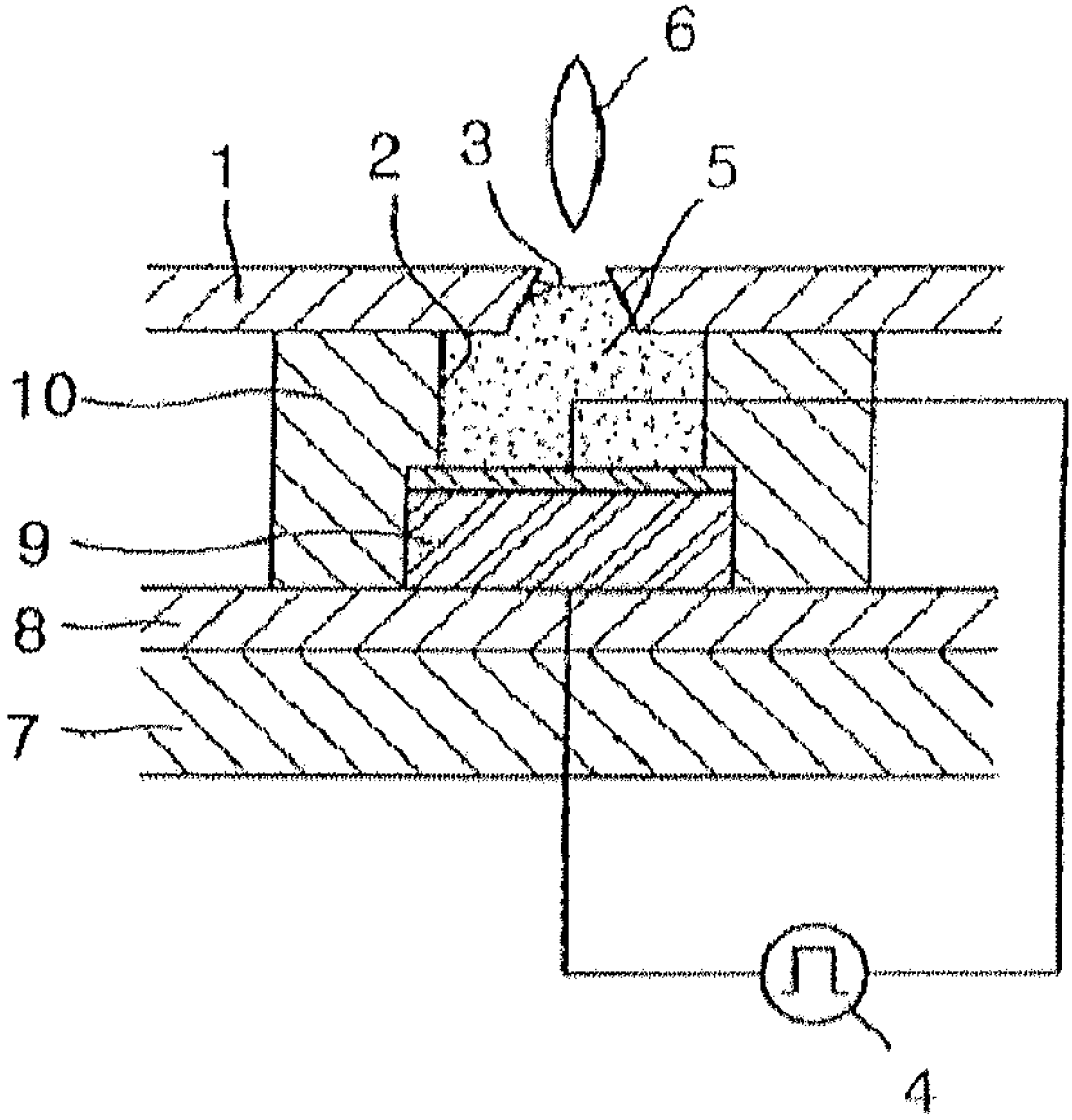
FIG. 1 (PRIOR ART)
FIG. 1 is a cross sectional view of a conventional piezoelectric type inkjet head.
Figure 2:
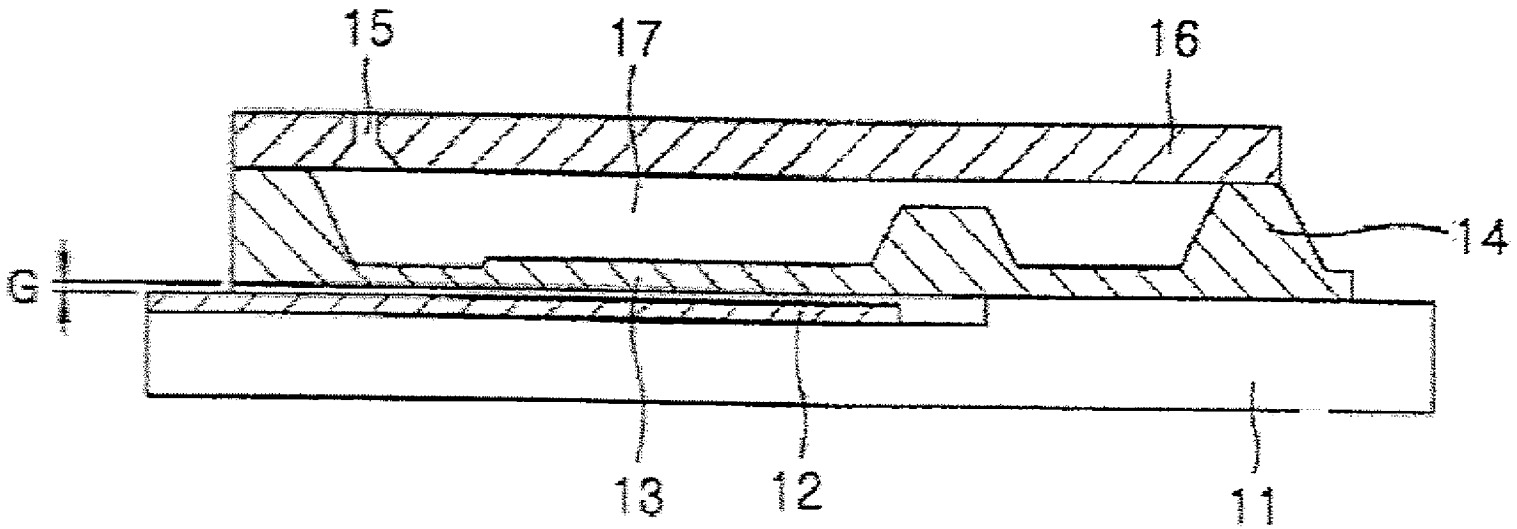
FIG. 2 (PRIOR ART)
FIG. 2 is a cross sectional view of a conventional electrostatic type inkjet head.

Legend of Reference Numbers for Major Components in the Figures

| | |
|---|---|
| 100: electrostatic actuator | 110: stator |
| 112: first protrusion part | 114: second protrusion part |
| 120: rotor | 122: first component |
| 124: second component | 126: third protrusion part |
| 128: fourth protrusion part | 130: ink chamber |
| 132: diaphragm | 134: ink nozzle |
| 136: ink injection opening | 138: ink droplet |
| 200: frame | |

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
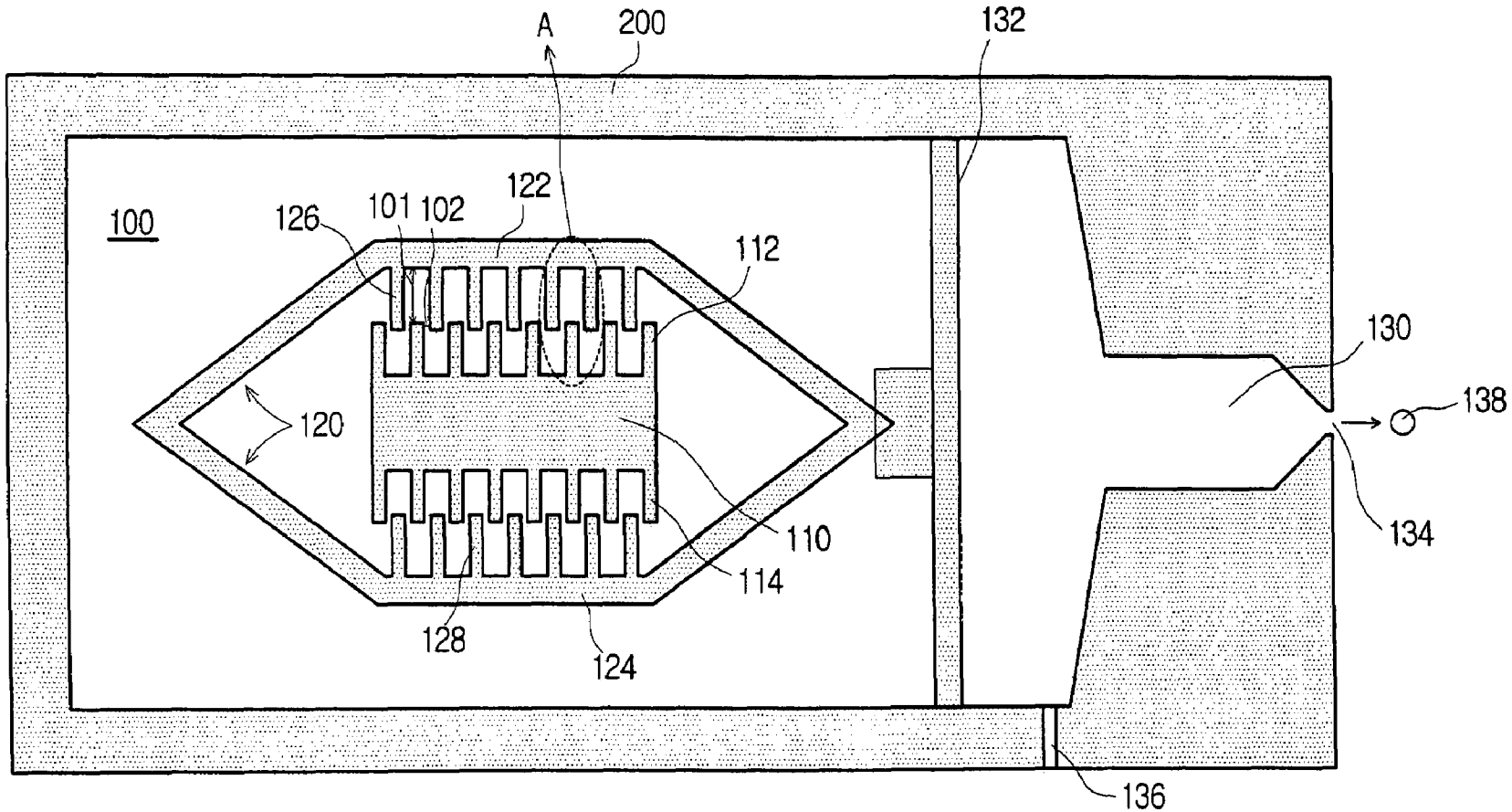
FIG. 3 is a cross sectional view of an inkjet head having an electrostatic actuator according to a first preferred embodiment of the invention.
Figure 4:
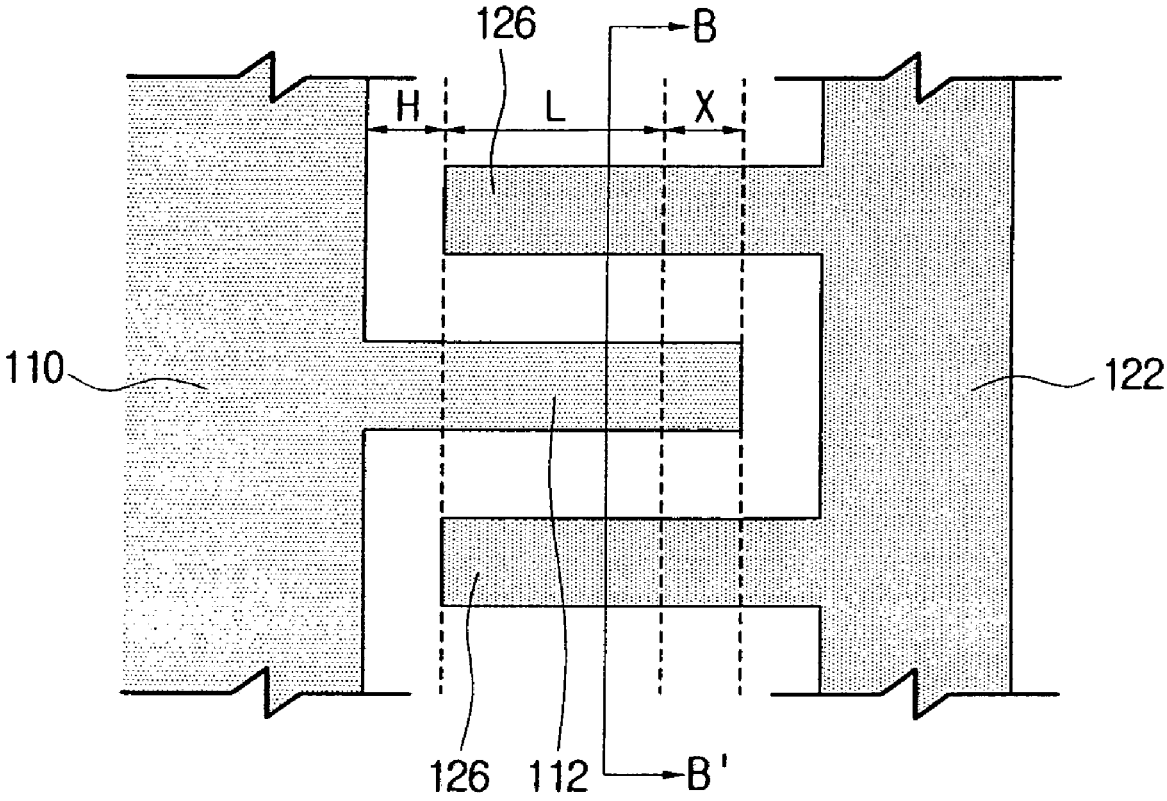
FIG. 4 is a magnified view of portion A in FIG. 3.
Figure 5:
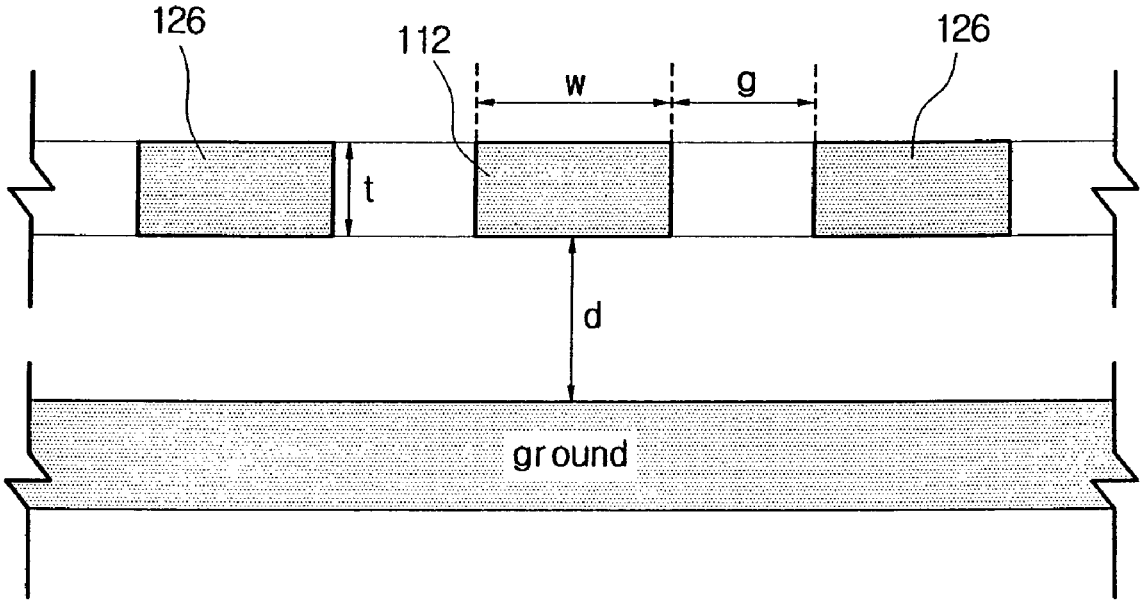
FIG. 5 is a cross sectional view across line B-B' in FIG. 4

FIG. 3 is a cross sectional view of an inkjet head having an electrostatic actuator according to a first preferred embodiment of the invention, FIG. 4 is a magnified view of portion A in FIG. 3, and FIG. 5 is a cross sectional view across line B-B' in FIG. 4. In FIGS. 3 to 5 are illustrated an electrostatic actuator 100, a stator 110, a first protrusion part 112, a second protrusion part 114, a rotor 120, a first component 122, a second component 124, a third protrusion part 126, a fourth protrusion part 128, an ink chamber 130, a diaphragm 132, an ink nozzle 134, an ink injection opening 136, an ink droplet 138, and a frame 200.

In the inkjet head having an electrostatic actuator according to a first embodiment, one end of the hexagonal electrostatic actuator 100 is secured to the diaphragm 132 of the ink chamber 130, so that when voltage is supplied to the stator 110 and the rotor 120 of the electrostatic actuator 100, an electrostatic force occurs between each other, and the shape of the electrostatic actuator 100 is changed. This applies pressure on the diaphragm 132, and as the volume of the ink chamber 130 is decreased, the ink inside the ink chamber 130 is sprayed through the ink nozzle 134. When voltage is not supplied, the diaphragm 132 returns to its original position due to the recovery ability of the electrostatic actuator 100, so that the volume of the ink chamber 130 increases, and ink flows in through the ink inlet and fills the ink chamber 130.

The inkjet head having an electrostatic actuator according to the invention may operate at frequencies higher by several tens of kHz compared to the conventional thermal type or piezoelectric type, and also has a simple manufacturing process to provide benefits in terms of productivity.

As seen in FIG. 3, the electrostatic actuator 100 comprises the comb pattern shaped stator 110, from which an n+1 number of first protrusion parts 112 and second protrusion parts 114 are protruded in both directions, and the rotor 120 composed of a hexagonal frame, from which an n number of third protrusion parts 126 facing the first protrusion parts and an n number of fourth protrusion parts 128 facing the second protrusion parts are protruded. The stator 110 and rotor 120 are formed from single crystal silicon, so that when voltage is supplied to the stator 110 and the rotor 120, an electrostatic force is generated which pulls the two toward each other.

The relationships between the supplied voltage and the generated electrostatic force and displacement are as shown in Equations (2) and (3). That is, when a voltage V as shown in Equation (1) is supplied to the stator 110 with the rotor 120 as the grounding, an electrostatic force $F_e$ as shown in Equations (2) and (3) is generated.

$$V = V_d + V_a \sin(\omega t) \tag{1}$$

$$F_e = \frac{1}{2}\left(\frac{\partial C}{\partial x} V^2\right) \tag{2}$$

$$F_e = \frac{1}{2}\frac{\partial C}{\partial x}\left(V_d^2 + \frac{1}{2}V_a^2 + 2V_aV_d\sin(\omega t) - \frac{1}{2}V_a^2\cos(2\omega t)\right) \tag{3}$$

where $V_d$: mean value of the voltage (volts)

$V_a$: amplitude of the AC voltage (volts)

ωt: resonance frequency x time (Hz·second)

C: electrostatic capacitance (F)

L: initial location (see FIG. 4)

H: distance between an end of the rotor and the stator (see FIG. 4)

w: width of a comb-pattern tooth (see FIG. 5)

In addition, Equation (4) is formulated from the above, and as seen in Equation (4), the distance by which the rotor 120 is deformed towards the stator 110 because of the electrostatic force is not dependent on the distance between the stator 110 and the rotor 120.

$$\frac{\partial C}{\partial x} = 2\frac{\varepsilon t}{g} \tag{4}$$

where

C: electrostatic capacitance (F)

x: distance moved of the rotor (see FIG. 4)

ϵ: permittivity t: thickness of the rotor (see FIG. 5)

g: gap between the first protrusion part and the third protrusion part or between the second protrusion part and the fourth protrusion part (see FIG. 5)

Solving for ∂C/∂x qualitatively will be explained in more detail with reference to FIGS. 4 and 5. If the comb pattern shaped rotor moves by x from the initial location L, the electrostatic capacitance generated by a line of electric force perpendicular to the rotor is calculated as Equation (5).

$$Cp=\{2\epsilon t(L+x)\}/g \tag{5}$$

As can be seen in Equation (5), the electrostatic capacitance generated at the end of the comb pattern composition will be constant when H is sufficiently greater than g. Therefore, as in Equation (4), ∂C/∂x is linear irrespective of x.

The electrostatic actuator 100 of the present embodiment is composed of the stator 110 and the rotor 120, where the stator 110 has protrusion parts formed in a comb pattern shape, and where the rotor 120 is a hexagonal enclosure, houses the stator 110 in its interior, and comprises a plurality of protrusion parts that mesh with the protrusion parts formed on the stator.

Preferably, the electrostatic actuator 100 of the present embodiment should comprise the stator 110 and the rotor 120, where the stator 110 is of a comb pattern shape with protrusion parts formed in both directions, and the rotor 120 should comprise two components and form a hexagonal compartment on which is formed protrusion parts that mesh with the protrusion parts of the stator 110.

In other words, the stator 110 is a comb pattern shape with a plurality of first protrusion parts 112 and second protrusion parts 114 formed in both directions and its position is affixed. The rotor 120 comprises the first component 122 and the second component 124, and both ends of the first component 122 and the second component are joined to form an enclosure which houses the stator 110 in its interior.

In FIG. 3, the protrusions on the upper portion of the stator 110 are the first protrusion parts 112, and the protrusions on the lower portion of the stator 110 are the second protrusion parts 114; the component on the upper portion of the rotor 120 is the first component 122, that on the lower portion is the second component 124; the protrusions towards the first protrusion parts 112 on the first component 122 facing the first protrusion parts 112 are the third protrusion parts 126, and the protrusions towards the second protrusion parts 114 on the second component 124 facing the second protrusion parts 114 are the fourth protrusion parts 128.

However, the order sequence of the reference numbers are rendered merely for the detailed explanation of the invention, and the constituents of the invention is not limited to the foregoing numbering order.

As seen in Equation (4), with the electrostatic actuator 100 of the invention, the magnitude of the electrostatic force depends not so much on the distance 101 between the stator 110 and the rotor 120, but on the distance between the protrusion parts, i.e. the distance 102 between the first protrusion parts 112 and the third protrusion parts 126 or between the second protrusion parts 114 and the fourth protrusion parts 128. Therefore, the displacement x by which the rotor 120 is moved is controlled by the difference in electric potential V, irrespective of the distance 101 between the stator 110 and the rotor 120, so that as the displacement of the rotor 120 is increased, the distance deformed by the diaphragm 132 as the electrostatic actuator applies pressure may be designed to be greater.

Thus, the first protrusion parts 112 and the third protrusion parts 126, or the second protrusion parts 114 and the fourth protrusion parts 128 should be formed so that the distance between their sides, i.e. the gap 102, is sufficiently small. Consequently, the distance 101 between the stator 110 and the rotor 120 is made less important compared to the case of a conventional head composition with flat opposing faces, and the reliability of the head's operation is improved.

The effects of the present embodiment may be obtained where one or more sets of first protrusion parts 112 and third protrusion parts 126, or of second protrusion parts 114 and fourth protrusion parts 128 are alternately aligned so that the sides are close to one another, but preferably, a plurality of protrusion parts should be formed to create a comb pattern composition.

Thus, when a plurality of first protrusion parts 112 and second protrusion parts 114 are formed in a comb pattern in both directions of the stator 110, and a corresponding plurality of third protrusion parts 126 and fourth protrusion parts 128 are formed in a comb pattern in both directions of the rotor 120 to be meshed together like gears, the area on which electrostatic force is applied on the stator 110 and the rotor 120 is maximized, to yield best results in utilizing the effect of the invention.

Of course, when positioning the comb pattern compositions to mesh with one another, they must not be electrically connected, i.e. they must be insulated, so that electrostatic forces may be generated.

A generally hexagonal enclosure is formed as the first component 122 and the second component 124 of the rotor 120 are joined at both ends, but the shape of the rotor 120 according to the invention is not necessarily limited to a hexagon, and may obviously be formed as an ellipse or curvature.

The overall shape of the rotor 120 should be formed so that, when electrostatic attraction occurs between the stator 110 and the rotor 120, the change in overall shape of the rotor 120 due the movement of the rotor 120 is maximized, especially the change in the horizontal direction in FIG. 3. This will utilize the electric force to more efficiently pressurize the diaphragm 132 of the ink chamber 130.

Since the inkjet head according to the invention generates electrostatic force irrespective of the distance between the stator 110 and the rotor 120, i.e. the minimum distance between the first protrusion parts 112 and the first component 122 or the minimum distance between the second protrusion parts 114 and the second component 124, the minimum distance may be made to be sufficiently great to maximize the displacement by which the rotor 120 is moved.

As described above, the distance between the first protrusion parts 112 and the third protrusion parts 126 or between the second protrusion parts 114 and the fourth protrusion parts 128 are important factors in determining the magnitude of electrostatic force in the present embodiment, the minimum distance between the first protrusion parts 112 and the first component 122 or the minimum distance between the second protrusion parts 114 and the second component 124 may be greater than the distance between the first protrusion parts 112 and the third protrusion parts 126 or the distance between the second protrusion parts 114 and the fourth protrusion parts 128.

Typically, when the thickness of the protrusion parts and the gaps in between fall in the range of several μm, the distance between the stator 110 and the rotor 120 (said minimum distance) may be equal or greater. By thus increasing the distance between the stator 110 and the rotor 120, the displacement by which the rotor 120 moves may be maximized, enabling the force by which the electrostatic actuator 100 pressurizes the diaphragm 132 is increased and consequently increasing the ink discharge pressure.

It is better if the cross section of the protrusion parts 112, 114, 126, 128 in the direction of protrusion is rectangular. However, the invention is not necessarily limited to cases with protrusion parts of rectangular cross sections, and shapes that may maximize the area to increase electrostatic force, such as triangular, trapezoidal, semicircular, elliptical, bell-shaped cross sections may obviously be included.

However, since the first component 122 and the second component 124 of the rotor 120 are components moved by electrostatic force, a rectangular shape is preferred over shapes that may cause mechanical problems during the movement. Also, since the invention uses electrostatic force generated between two parallel electrodes facing each other, a shape such as a rectangle that provides more parallel areas facing one another is preferred over a shape such as a triangle or trapezoid in which the distance between protrusion parts may be different for each position.

The protrusion parts 112, 114, 126, 128 are each formed in plurality, but the forms need not be identical. In other words, the forms may differ for the first component 122 or the second component 124 at the central part and the end parts, and various forms may be used to obtain a greater electrostatic force.

However, each protrusion part with identical forms repeated may be preferred in terms of design and manufacturing convenience. The protrusion parts 112 and the third protrusion parts 126, or the second protrusion parts 114 and the fourth protrusion parts 128 may also have different forms, but as stated above, identical forms for the protrusion parts may be preferred for convenience in design and manufacture.

Also, since the electrostatic actuator 100 according to the invention involves the rotor 120 positioned symmetrically in the upper and lower directions of the stator 110 moving due to the electrostatic attraction of the rotor 120 towards the stator 110 so that the shape of the electrostatic actuator 100 is elongated horizontally as in FIG. 3 to pressurize the diaphragm 132, forming the first protrusion parts 112 and the second protrusion parts 114, and also the third protrusion parts 126 and the fourth protrusion parts 128 to be symmetrical is the most efficient in deforming the electrostatic actuator 100.

Also, all compositions of the comb patterned electrostatic actuator 100 according to the invention should preferably be manufactured by MEMS(Micro Electro Mechanical System) processes. MEMS is a technology of manufacturing electromechanical elements at a micro scale, invisible to the human eye, and is used in applications of all fields related to minute mechanical compositions.

MEMS technology is an application of micro processing technology to the manufacture of micro sensors or actuators and electromechanical compositions of microscopic scale, and is a form of micro processing technology applying conventional semiconductor processes, especially integrated circuit technology. A micro machine manufactured by MEMS may achieve an accuracy of below the μm scale. It must be possible for the stator 110 and the rotor 120 of the invention to be manufactured at sizes under several μm, and since they are parts operated mechanically by electrostatic force, it is preferable that they be manufactured by the above-mentioned MEMS processes.

However, the manufacturing process for the electrostatic actuator 100 of the invention is not limited to MEMS, and all manufacturing processes that can obtain the effects of the invention within the bounds apparent to those skilled in the art may obviously be used.

Preferably, the stator 110 and the rotor 120 should be formed as a single body, and they should be manufactured with single crystal silicon. However, the material of the stator 110 and the rotor 120 according to the invention is not limited, and any other materials that satisfy the electrical and mechanical requirements and obtain the effects of the invention within the bounds apparent to those skilled in the art may obviously be included.

Figure 6:
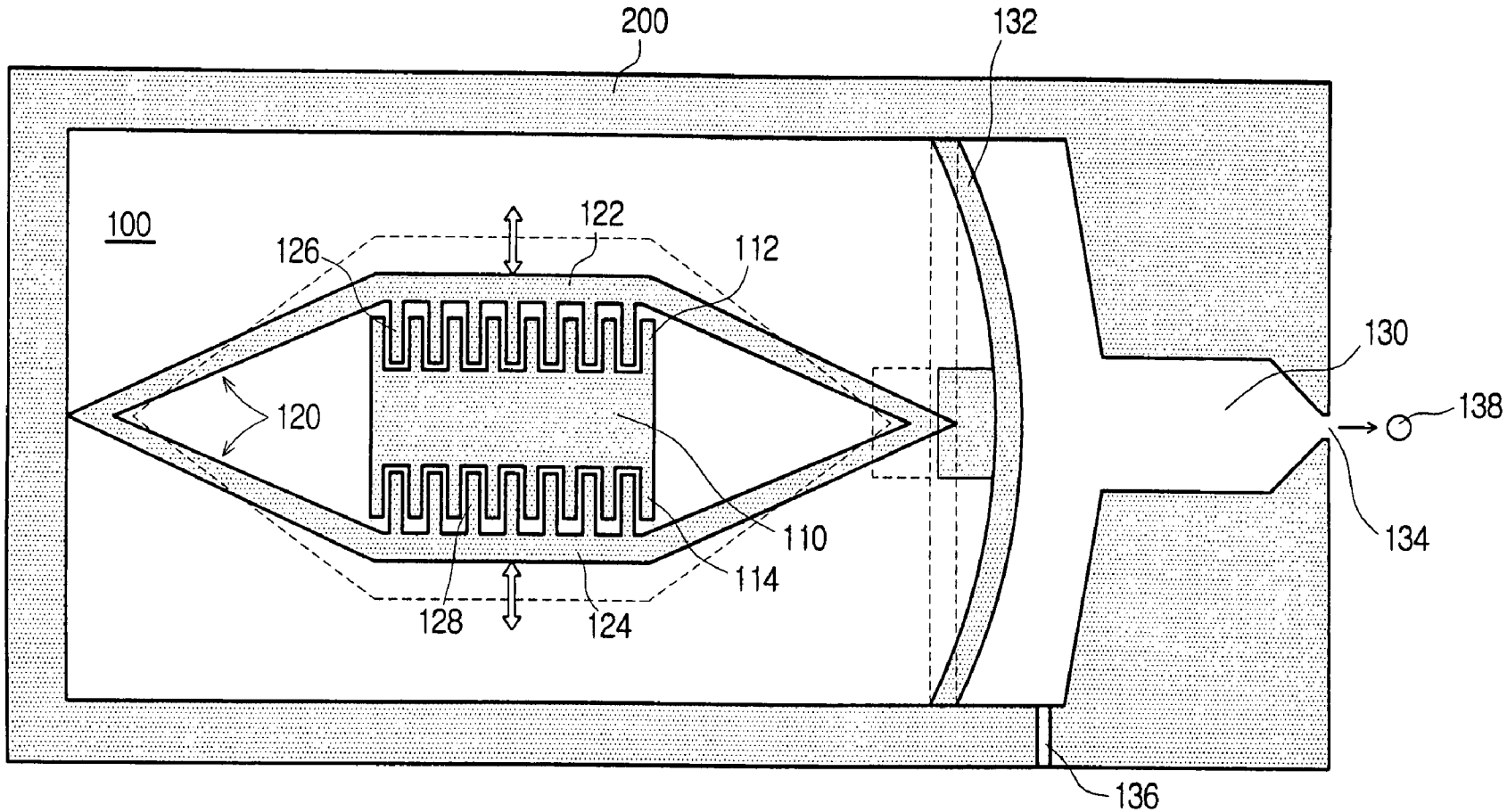
FIG. 6 is a cross sectional view when voltage is supplied to an inkjet head having an electrostatic actuator according to a first preferred embodiment of the invention.

FIG. 6 is a cross sectional view when voltage is supplied to an inkjet head having an electrostatic actuator according to a first preferred embodiment of the invention. In FIG. 6 are illustrated the electrostatic actuator 100, stator 110, first protrusion parts 112, second protrusion parts 114, rotor 120, first component 122, second component 124, third protrusion parts 126, fourth protrusion parts 128, ink chamber 130, diaphragm 132, ink nozzle 134, ink injection opening 136, ink droplet 138, and frame 200.

With the inkjet head according to the present embodiment, the electrostatic actuator 100 and the ink chamber 130 are housed in the interior of the frame 200, and an end of the electrostatic actuator 100 is secured to the diaphragm 132 of the ink chamber 130. As in the foregoing description, the ink chamber 130 comprises a diaphragm 132 formed at a portion corresponding to the other end of the electrostatic actuator 100 and deformable by pressure, an ink nozzle 134 formed at a portion joining the frame 200 through which ink is sprayed when pressurized, and an ink injection opening 136. As described above, the electrostatic actuator 100 comprises the stator 110 and the rotor 120 of comb pattern composition.

As seen in FIG. 6, with the inkjet head having an electrostatic actuator 100 according to the invention, the rotor 120 is moved due to the electrostatic force generated in proportion to the square of the supplied voltage when voltage is supplied to the stator 110 and the rotor 120. That is, the vertical size of the electrostatic actuator 100 of FIG. 6 is decreased, and thus the horizontal size of the electrostatic actuator 100 is increased. This causes the diaphragm 132 of the ink chamber 130 joined to the electrostatic actuator 100 to be pressurized, so that ink filled in the ink chamber 130 is sprayed out through the ink nozzle 134 as the volume of the ink chamber 130 is decreased.

When the voltage supply is shut off and the rotor 120 returns to its original form, the volume of the ink chamber 130 is expanded again to its original state, so that ink is supplied from an ink source (not shown) through the ink inlet and filled in the ink chamber 130.

When voltage is supplied to the stator 110 and the rotor 120 to expand the horizontal size of the electrostatic actuator 100 in FIG. 6, pressure is applied to both ends of the electrostatic actuator 100. To maximize the transfer of pressure from the electrostatic actuator 100 to the diaphragm 132 of the ink chamber 130, the other end of the electrostatic actuator 100 may be secured to the frame 200. Since the frame 200 does not deform, the electrostatic actuator 100 will expand and contract only in the direction of the diaphragm 132, and the pressure caused by electrostatic force is transferred only towards the diaphragm 132.

However, when the electrostatic actuator 100 deforms only in the direction of the diaphragm 132, the rotor 120 not only moves towards the stator 110 but also moves towards the diaphragm 132. This raises the possibility of contact between the first protrusion parts 112 of the stator 110 and the third protrusion parts 126 of the rotor 120, or between the second protrusion parts 114 of the stator 110 and the fourth protrusion parts 128 of the rotor 120. Therefore, in this case, it is better to let only one end of the electrostatic actuator 100 be joined to the diaphragm 132, with the other end freely movable.

However, when the other end of the electrostatic actuator 100 is configured to be a free end, there is a risk that the rotor 120 will move in the opposite direction of the diaphragm 132 as a reaction to the electrostatic actuator 100 pressurizing the diaphragm 132. Therefore, it is preferable that an elastic or deformable element be placed to join the other end of the electrostatic actuator 100 to the frame or that the other end of the electrostatic actuator 100 be designed to meet the frame 200 when the electrostatic actuator 100 is elongated to its maximum.

As the electrostatic actuator 100 according to the invention involves an enclosure in the shape of a hexagon, etc., deforming to pressurize the diaphragm 132, the distance moved by the rotor 120 is not necessarily equal to the distance deformed by the diaphragm 132. Therefore, the other end of the electrostatic actuator 100 may be secured to the frame 200, if the displacement by which the diaphragm 132 is deformed is sufficient to obtain the effects of the invention in the range as long as there is no contact between the first protrusion parts 112 of the stator 110 and the third protrusion parts 126 of the rotor 120, or between the second protrusion parts 114 of the stator 110 and the fourth protrusion parts 128 of the rotor 120.

Figure 7:
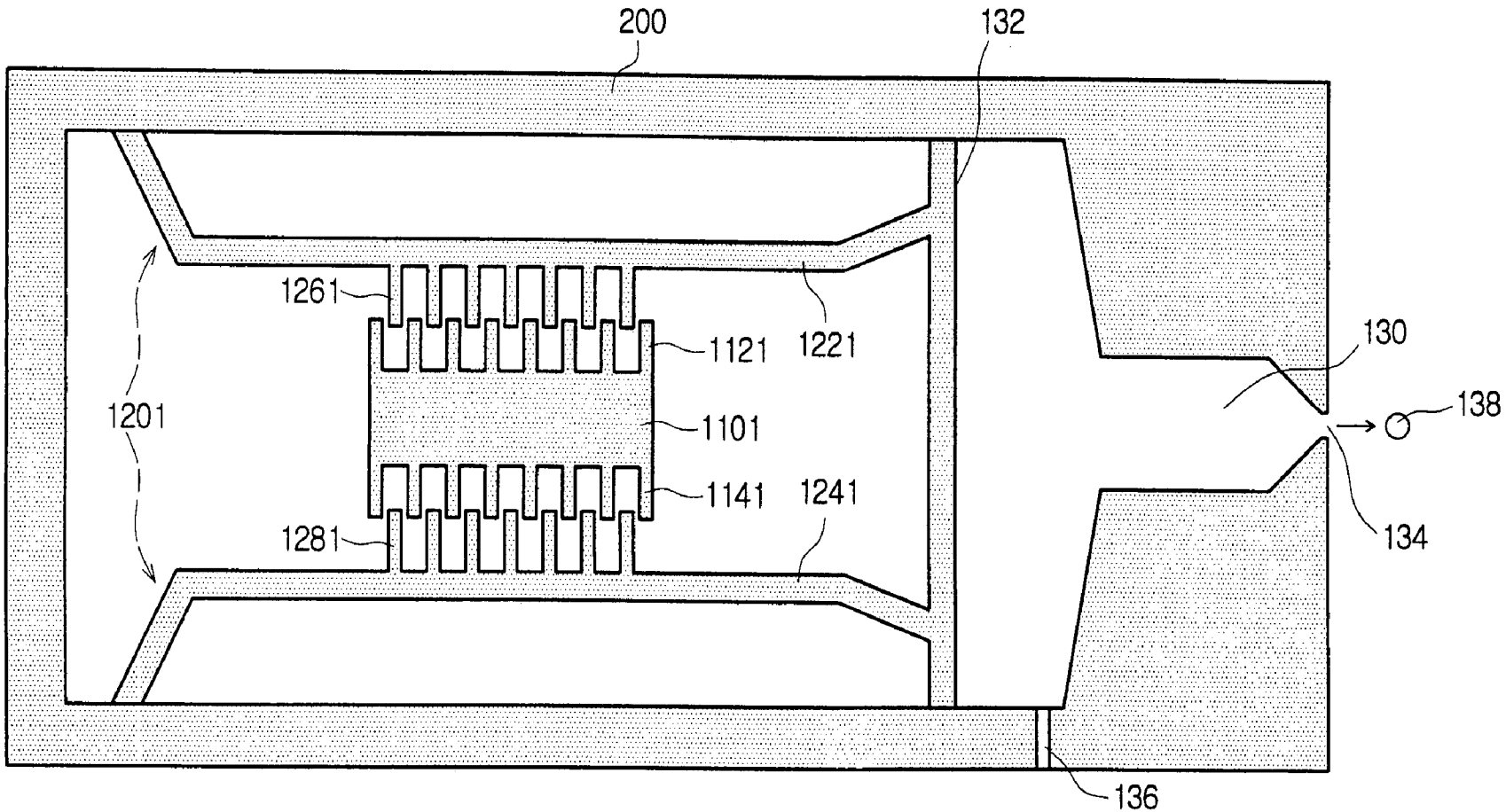
FIG. 7 is a cross sectional view of an inkjet head having an electrostatic actuator according to a second preferred embodiment of the invention.
Figure 8:
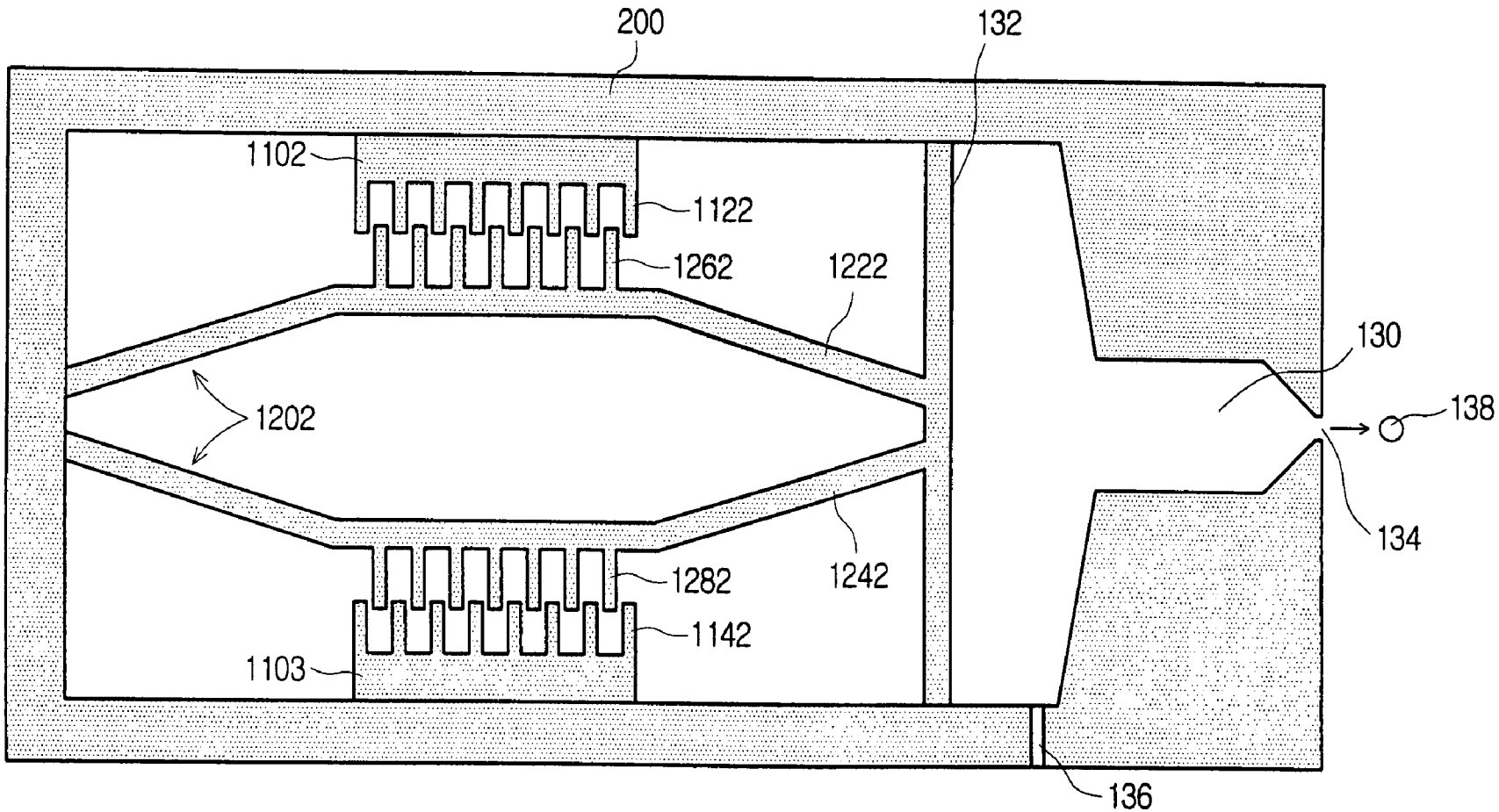
FIG. 8 is a cross sectional view of an inkjet head having an electrostatic actuator according to a third preferred embodiment of the invention.

FIG. 7 is a cross sectional view of an inkjet head having an electrostatic actuator according to a second preferred embodiment of the invention, and FIG. 8 is a cross sectional view of an inkjet head having an electrostatic actuator according to a third preferred embodiment of the invention. In FIG. 7 are illustrated a stator 1101, first protrusion parts 1121, second protrusion parts 1141, a rotor 1201, a first component 1221, a second component 1241, third protrusion parts 1261, and fourth protrusion parts 1281, and in FIG. 8 are illustrated stators 1102, 1103, first protrusion parts 1122, second protrusion parts 1142, a rotor 1202, a first component 1222, a second component 1242, third protrusion parts 1262, and fourth protrusion parts 1282.

The rotor of the electrostatic actuator according to the invention is not necessarily limited to forming an enclosure of hexagonal shape, etc., as in the first embodiment. That is, the rotor does not necessarily form an enclosure, and it is to be appreciated that the case wherein the rotor is separated into the first component and the second component and the stator is separated into two parts with the rotor positioned facing each stator is also included in the invention.

Even when the first component 1221 and the second component 1241 of the rotor are separated as in the second embodiment of FIG. 7, if an end of each component is joined to the diaphragm 132, the rotor 1201 is moved towards the stator 1101 by the electrostatic attraction, so that an end of the rotor causes the diaphragm 132 to deform, and this deformation and recovery of the diaphragm 132 allow the diaphragm 132 to apply pressure to the ink chamber 130 and discharge the ink.

Also, even when the stator is not a comb pattern composition with a plurality of protrusion parts in both directions as in FIG. 3, but is instead formed with a plurality of separate components 1102, 1103 as in the third embodiment of FIG. 8, if the rotor 1222, 1242 is installed facing each stator 1102, 1103 with an end joined to the diaphragm 132, the rotors 1222, 1242 are moved towards the stators 1102, 1103 due to the electrostatic attraction between the stators and the rotors, so that as before mentioned, the ends of the rotors 1222, 1242 cause the diaphragm 132 to deform, allowing the diaphragm to pressurize the ink chamber 130.

Of course, it is preferable that the end of each of the plurality of rotors join at one position on the diaphragm, as the deformation force applied by the rotor on the diaphragm may be concentrated, a preferred embodiment of which is forming the rotor to be a hexagonal enclosure as described in FIG. 3.

Figure 9:
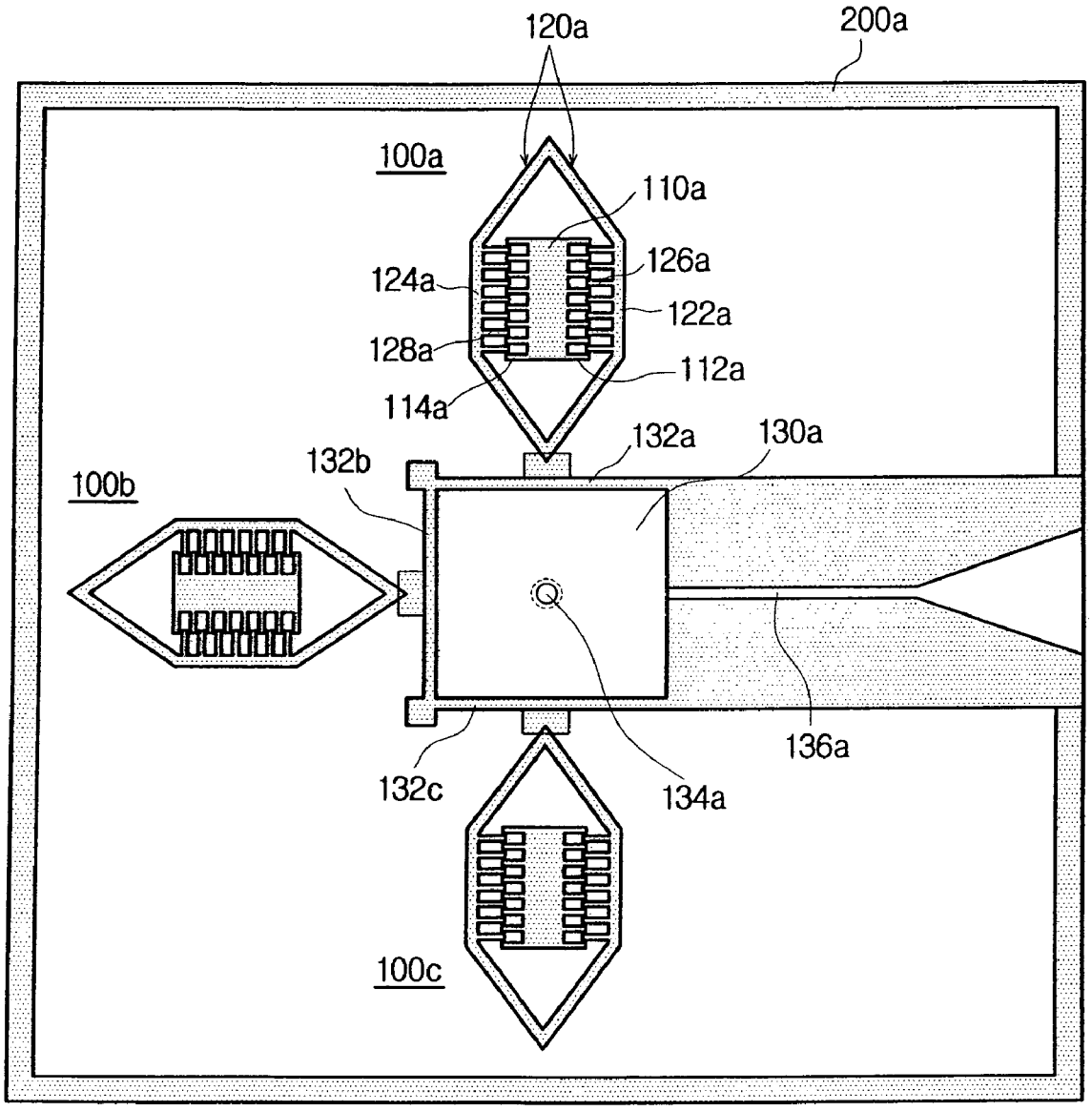
FIG. 9 is a cross sectional view of an inkjet head having electrostatic actuators according to a fourth preferred embodiment of the invention.
Figure 10:
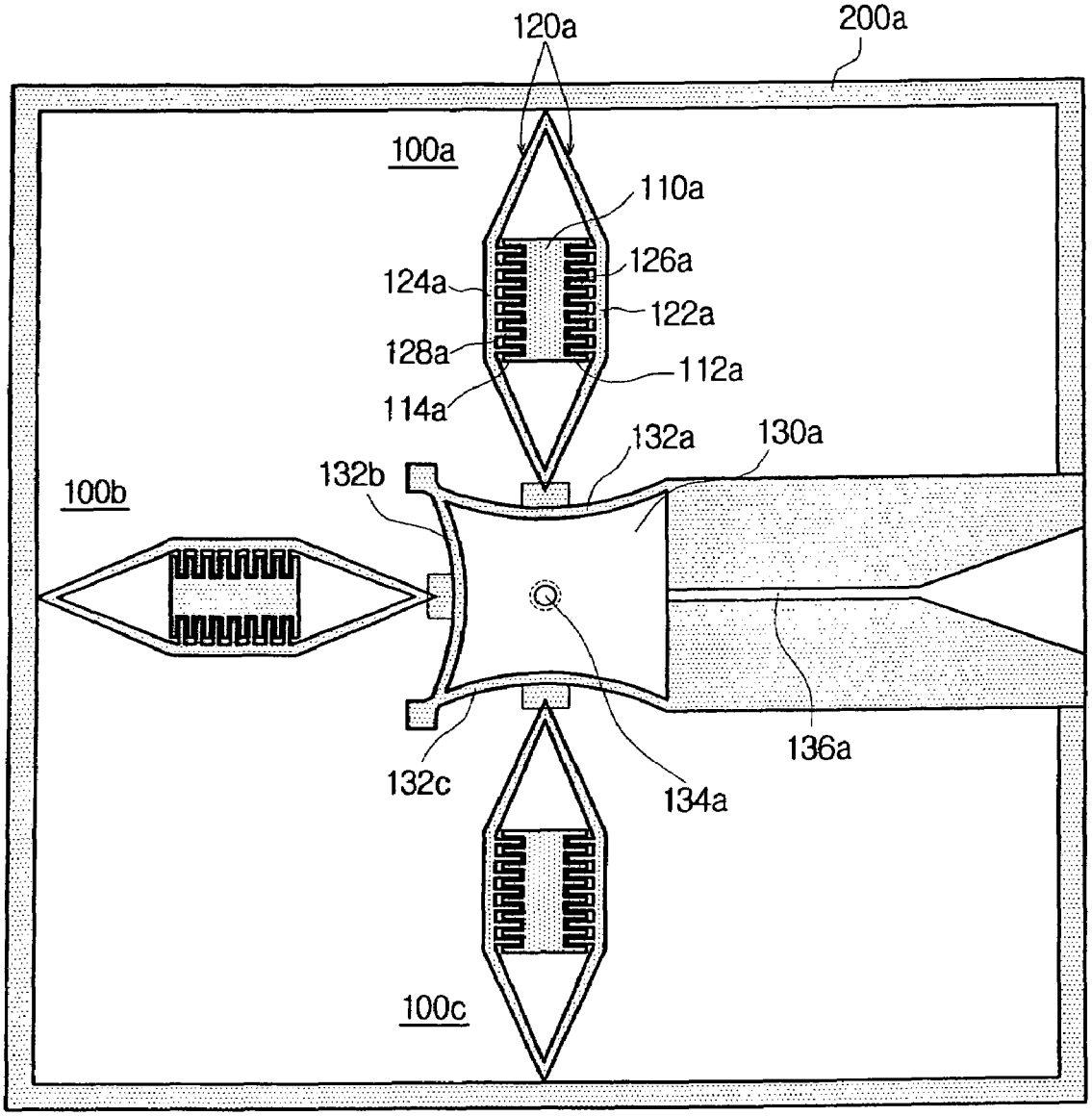
FIG. 10 is a cross sectional view when voltage is supplied to an inkjet head having electrostatic actuators according to a fourth preferred embodiment of the invention.

FIG. 9 is a cross sectional view of an inkjet head having electrostatic actuators according to a fourth preferred embodiment of the invention, and FIG. 10 is a cross sectional view when voltage is supplied to an inkjet head having electrostatic actuators according to the fourth preferred embodiment of the invention. In FIGS. 9 and 10 are illustrated electrostatic actuators 100*a*, 100*b*, 100*c*, a stator 110*a*, first protrusion parts 112*a*, second protrusion parts 114*a*, a rotor 120*a*, a first component 122*a*, a second component 124*a*, third protrusion parts 126*a*, fourth protrusion parts 128*a*, an ink chamber 130*a*, diaphragms 132*a*, 132*b*, 132*c*, an ink nozzle 134*a*, an ink injection opening 136*a*, and a frame 200*a*.

Explaining the composition of the inkjet head according to the fourth embodiment with reference to FIG. 9, the ink chamber 130*a* is housed inside frame 200*a*, a diaphragm 132*a*, 132*b*, 132*c* is formed on each side of the ink chamber 130*a*, and an electrostatic actuator 100 as explained in the first embodiment is joined to each diaphragm 132*a*, 132*b*, 132*c*. In FIG. 9, one side of the square ink chamber 130*a* is formed with the ink injection opening, while the remaining three sides are formed with diaphragms 132*a*, 132*b*, 132*c*. The electrostatic actuators are joined to the diaphragms 132*a*, 132*b*, 132*c*, respectively, so that a total of three electrostatic actuators 100*a*, 100*b*, 100*c* are joined. At one end of the ink chamber 130*a* (vertically upward in FIG. 9), the ink nozzle 134*a* is formed, so that by applying pressure on the diaphragms 132*a*, 132*b*, 132*c*, ink may be discharged through the ink nozzle 134*a*.

The fourth embodiment involves a plurality of diaphragms 132*a*, 132*b*, 132*c* formed on the ink chamber 130*a* housed in the frame 200*a* with an electrostatic actuator 100 joined to each diaphragm, each electrostatic actuator 100*a*, 100*b*, 100*c* pressurizing a diaphragm 132*a*, 132*b*, 132*c* as it deforms, so that on the whole, the volume of the ink chamber 130*a* is reduced as compared to the case with one electrostatic actuator. This allows a greater amount of ink discharged from the ink chamber 130*a*, or allows the use of high viscosity ink, which could not be used before due to the limit in electrostatic force. Meanwhile, when a small amount of ink is sprayed by decreasing the pressure applied to the ink chamber 130*a*, or when an ink with low viscosity is sprayed, the difference in electrical potential, etc., supplied to the electrostatic actuator 100 may be controlled to decrease the electrostatic force.

Thus, the inkjet head described above and an ink cartridge and inkjet printer using the same may spray greater amounts of ink, or may use high viscosity ink in printing, so that applicability is enhanced. Of course, use of smaller amounts of ink or low viscosity ink does not present a problem, because the difference in electrical potential, etc. may be controlled, as described above.

Preferably, the ink chamber 130*a* should be manufactured to have a polygonal cross section, with a diaphragm 132*a*, 132*b*, 132*c* formed on each side of the polygon, and an electrostatic actuator joined to each diaphragm. Since a greater number of sides on the polygon entails a greater number of electrostatic actuator joined, it is best to form a polygonal ink chamber 130*a* having a sufficient number of sides considering difficulty, time, and cost of manufacturing, and required ink discharge pressure, etc.

However, the cross section of the ink chamber according to the invention is not necessarily limited to a polygon, and such shapes as a circle, ellipse, and curvature, etc., that includes curves may obviously be used. When forming the ink chamber to have a curved cross section, the parts corresponding to both ends of each diaphragm should preferably be secured to efficiently transfer pressure from the electrostatic actuator to the ink chamber.

Meanwhile, a diaphragm does not necessarily have to be joined with just one electrostatic actuator, and a plurality of electrostatic actuators may be joined to a diaphragm.

When a plurality of electrostatic actuators are joined to each diaphragm, the elongated displacements of the electrostatic actuators are not added together, but since the diaphragm is pressurized from two or more points instead of being pressurized from just one point, the resulting reduction in ink chamber volume is increased. Of course, a plurality of electrostatic actuators may be joined to the diaphragm in the first embodiment also to increase the ink discharge pressure.

The invention relates to a hexagonal inkjet head having an electrostatic actuator comprising a stator and a rotor, wherein protrusion parts of comb pattern composition formed on the stator and the rotor are meshed together, and the scope of the invention encompasses not only the inkjet head having an electrostatic actuator but also an inkjet cartridge and inkjet printer using the above inkjet head.

In the fourth embodiment also, when voltage is supplied to the stator 110*a* and the rotor 120*a*, the rotor 120*a* is moved due to the electrostatic force generated in proportion to the square of the supplied voltage. That is, for an electrostatic actuator 100*a*, 100*b*, 100*c*, if the direction of protrusion of the protrusion parts of the stator 110*a* or the rotor 120*a* is regarded as the width direction, and the direction perpendicular to the width direction is regarded as the length direction, the size of the electrostatic actuator 100 in the width direction is decreased, and the size in the length direction is increased, with the movement of the rotor 120*a*.

This causes the diaphragm 132*a*, 132*b*, 132*c* of the ink chamber joined to the electrostatic actuator to be pressurized, and the volume of the ink chamber is decreased, so that the ink filled in the ink chamber is sprayed through the ink nozzle 134*a*. In the case of the fourth embodiment, three electrostatic actuators 100*a*, 100*b*, 100*c* are used, so that the ink discharge pressure is greater than in the case of the first embodiment.

When the supplied voltage is shut off and the rotor 120*a* returns to its original form, the volume of the ink chamber 130*a* is increased to its normal size, so that that ink is supplied from an ink source (not shown) through the ink inlet which and filled in the ink chamber 130*a*.

Figure 11:
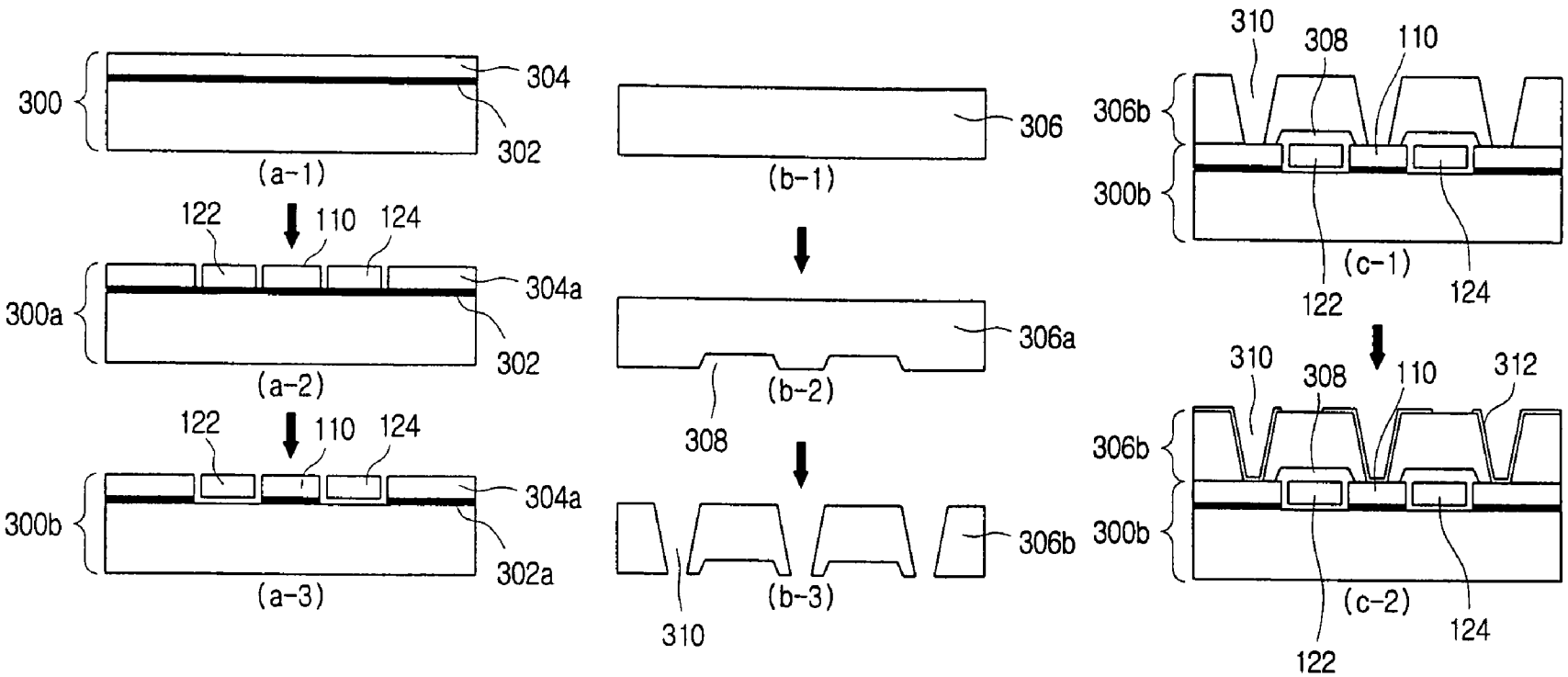
FIG. 11 is a diagram illustrating the manufacturing process of an inkjet head having an electrostatic actuator according to a preferred embodiment of the invention.
Figure 12:
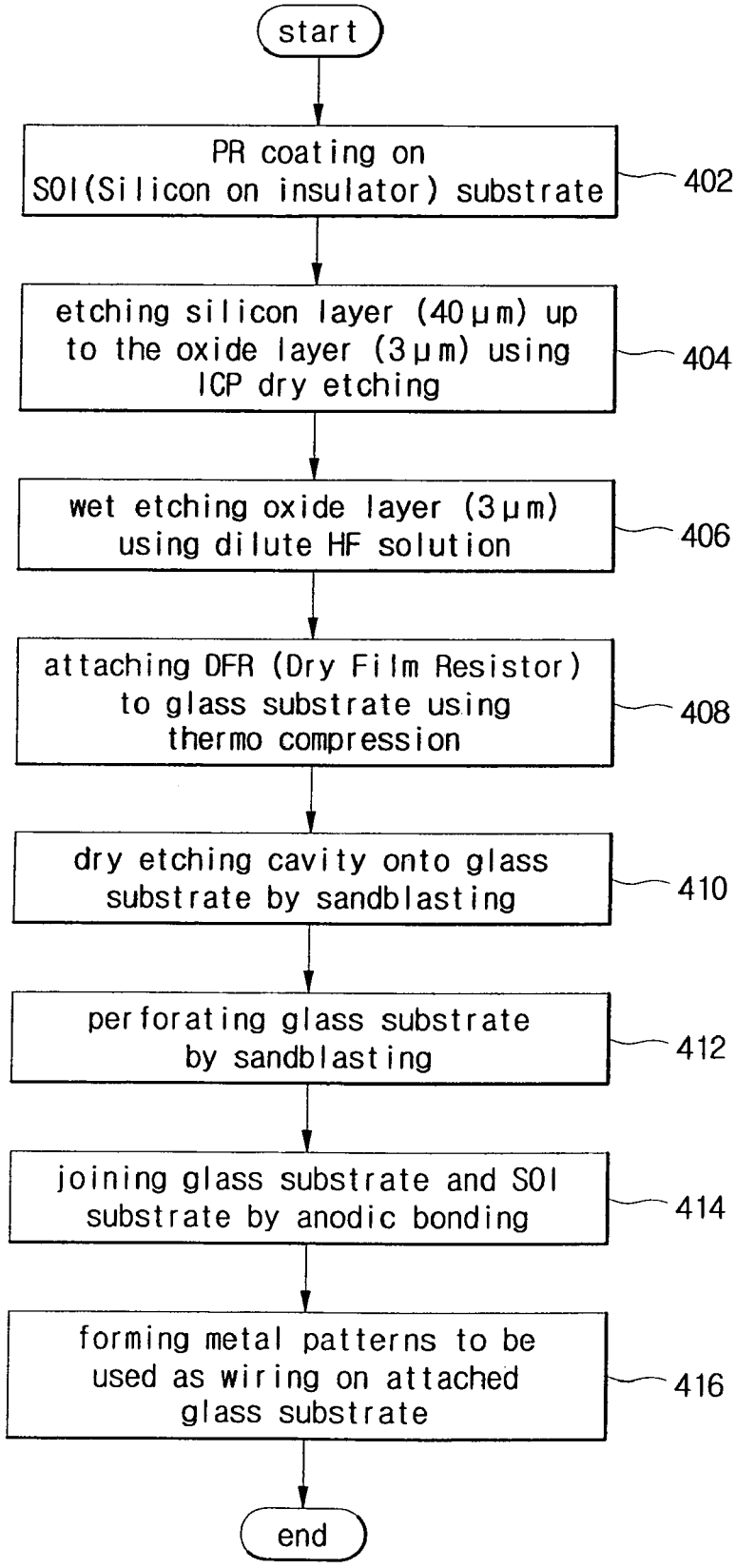
FIG. 12 is a flowchart illustrating the manufacturing process of an inkjet head having an electrostatic actuator according to a preferred embodiment of the invention.

FIG. 11 is a diagram illustrating the manufacturing process of an inkjet head having an electrostatic actuator according to a preferred embodiment of the invention, and FIG. 12 is a flowchart illustrating the manufacturing process of an inkjet head having an electrostatic actuator according to a preferred embodiment of the invention. In FIG. 11 is illustrated a SOI substrate 300, an oxide layer 302, a silicon layer 304, a glass substrate 306, and metal patterns 312.

An electrostatic actuator according to the invention may, as described above, be manufactured with ease and precision using MEMS technology. In explaining the manufacturing process of an electrostatic actuator according to the present embodiment, the SOI substrate is first processed.

The SOI substrate is processed by a method comprising: forming a PR coating layer (not shown) on a SOI (Silicon on Insulator) substrate 300, on which a silicon layer 304 is formed on an oxide layer 302, and afterwards forming patterns of the stator 110 and the rotors 122, 124 of the electrostatic actuator on the PR coating layer (PR patterning) ((a-1) of FIG. 11), etching the silicon layer 304*a* of the SOI substrate 300*a* up to the oxide layer 302 according to the patterns formed ((a-2) of FIG. 11), and etching the oxide layer 302*a* of the rotor 122, 124 parts ((a-3) of FIG. 11).

Next, the glass substrate is processed. The glass substrate is processed by a method comprising: attaching a DFR (Dry Film Resistor) (not shown) to the upper face of the glass substrate 306 ((b-1) of FIG. 11), etching a cavity onto parts of the bottom face of the glass substrate 306*a* corresponding to the rotor 122, 124 formed on the processed SOI substrate 300*b* ((b-2) of FIG. 11), and perforating parts of the glass substrate 306*b* corresponding to the stator 110 ((b-3) of FIG. 11).

After processing the SOI substrate and the glass substrate, the processed glass substrate 306*b* is joined onto the processed SOI substrate 300*b*, on which metal patterns 312 that will be used as wiring are formed to produce an electrostatic actuator.

For the etching of the silicon layer 304*a*, any method apparent to those skilled in the art may be utilized, such as ICP dry etching, etc., and for the etching of the oxide layer 302*a* of the rotor 122, 124 parts, any method apparent to those skilled in the art may be utilized, such as wet etching using a dilute HF solution.

Further, any method apparent to those skilled in the art may be utilized for attaching the DFR to the upper face of the glass substrate 306, and any method apparent to those skilled in the art may be utilized for etching a cavity onto parts of the bottom face of the glass substrate 306*a* and for perforating the glass substrate 306*b*, such as sandblasting.

Of course, any method apparent to those skilled in the art may be utilized also for the joining of the processed SOI substrate 300*b* and the processed glass substrate 306*b*, such as anodic bonding.

Representing the foregoing manufacturing method of the inkjet head using the preferred processing methods and MEMS technology with a flowchart as seen in FIG. 12, PR coating is applied to a SOI (Silicon on insulator) substrate 402, the silicon layer (approximately 40 μm) is etched up to the oxide layer (approximately 3 μm) using ICP dry etching 404, the oxide layer is wet etched using a dilute HF solution 406, a DFR (Dry Film Resistor) is attached to the glass substrate using thermo compression 408, a cavity is dry etched onto the glass substrate by sandblasting 410, the glass substrate is perforated by sandblasting 412, the glass substrate from step 412 is joined onto the SOI substrate from step 406 by anodic bonding 414, and metal patterns that will be used as wiring are formed on the attached glass substrate 416.

While the spirit of the invention has been described in detail with reference to particular embodiments, the embodiments are for illustrative purposes only and do not limit the invention. It is to be appreciated by those skilled in the art that various embodiments are possible without departing from the scope and spirit of the invention.

INDUSTRIAL AVAILABILITY

According to the present invention comprised as above mentioned, the sizes of the stator and the rotor may be reduced, and since the gap between the stator and the rotor is under several μm, the sizes of head parts, such as the pressure chamber and the diaphragm, etc., in a nozzle of a printer head may be manufactured in the order of a several hundred μm, the size of the overall head composition may be reduced.

Also, since one or more electrostatic actuators of comb pattern design can increase the electrostatic force, the displacement of the diaphragm or the volume decrease of the ink chamber may be increased with a low voltage, so that the ink discharge pressure may be increased, thereby allowing the discharge of high viscosity ink. Further, by controlling the design parameters such as the thickness of the frame, the voltage, and the degree of vacuum, the head may be designed freely according to specific discharge requirements.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet head having an electrostatic actuator, comprising:

one or more stators, on which a plurality of first protrusion parts are formed in a comb pattern shape;

one or more rotors facing the first protrusion parts, which mesh with the first protrusion parts without contact; and a diaphragm joined to an end of the rotors, wherein the rotor is the shape of an enclosure which houses the stator in its interior.

2. The inkjet head having an electrostatic actuator of claim 1, wherein the enclosure has a hexagonal or elliptical shape.

3. The inkjet head having an electrostatic actuator of claim 1, wherein the stator or the rotor comprises single crystal silicon.

4. The inkjet head having an electrostatic actuator of claim 1, wherein the stator or the rotor is produced by MEMS (Micro Electro Mechanical System) processes.

5. The inkjet head having an electrostatic actuator of claim 1, further comprising:

a frame, which houses an electrostatic actuator consisting of the stator and the rotor housing the stator;

an ink chamber housed in the frame comprising the diaphragm on one or more faces;

an ink nozzle formed on a side of the ink chamber; and an ink injection opening joined to the ink chamber;

wherein an end of the electrostatic actuator joins with the diaphragm.

6. The inkjet head having an electrostatic actuator of claim 5, wherein the cross section of the ink chamber is a polygon; the diapragm optionally included on each side of the polygon; and the electrostatic actuator is joined to each diaphragm.

7. The inkjet head having an electrostatic actuator of claim 6, wherein a plurality of electrostatic actuators are joined to the diaphragm.

8. An ink cartridge having an electrostatic actuator, comprising the inkjet head of claim 5.

9. An inkjet printer having an electrostatic actuator, comprising:

the ink cartridge of claim 8; and an operation circuit which supplies power to the stator or the rotor.

10. An inkjet head having an electrostatic actuator, comprising:

a stator, on which is formed a plurality of comb pattern shaped first protrusion parts and second protrusion parts in both directions; and a rotor consisting of a first component and a second component, the ends of which join with a diaphragm;

wherein a third protrusion part is formed on the first component, facing the first protrusion parts and meshing with the first protrusion parts without contact; and a fourth protrusion part is formed on the second component, facing the second protrusion parts and meshing with the second protrusion parts without contact.

11. The inkjet head having an electrostatic actuator of claim 10, wherein both ends of the first component and the second component are joined so that the rotor forms an enclosure which houses the stator in its interior.

12. The inkjet head having an electrostatic actuator of claim 11, wherein the enclosure has a hexagonal or elliptical shape.

13. The inkjet head having an electrostatic actuator of claim 10, wherein the shortest distance between the first protrusion part and the first component or the shortest distance between the second protrusion part and the second component is greater than the distance between the first protrusion part and the third protrusion part or the distance between the second protrusion part and the fourth protrusion part.

14. The inkjet head having an electrostatic actuator of claim 10, wherein the shape of a cross section in the direction of protrusion in one or more of the first protrusion part to the fourth protrusion part is rectangular.

15. The inkjet head having an electrostatic actuator of claim 10, wherein two or more of the first protrusion part to the fourth protrusion part have an identical form.

16. The inkjet head having an electrostatic actuator of claim 10 wherein the stator or the rotor comprises single crystal silicon.

17. The inkjet head having an electrostatic actuator of claim 10, wherein the stator or the rotor is produced by MEMS (Micro Electro Mechanical System) processes.

18. The inkjet head having an electrostatic actuator of claim 10, further comprising:

a frame, which houses an electrostatic actuator consisting of the stator and the rotor housing the stator;

an ink chamber housed in the frame comprising the diaphragm on one or more faces;

an ink nozzle formed on a side of the ink chamber; and an ink injection opening joined to the ink chamber;

wherein an end of the electrostatic actuator joins with the diaphragm.

* * * * *